United States Patent [19]

Champion et al.

[11] 4,292,975

[45] Oct. 6, 1981

[54] BRASSIERE

[76] Inventors: Carolyn Champion, 34 Theroux Dr., Chicopee, Mass. 01020; Judith Wolcott, 107 Clairmont Ave., Chicopee, Mass. 01013; Barbara Hart, 131 Woodbridge St., South Hadley, Mass. 01075; Zulma C. Garcia, 114-40 22 1st St., Queens Village, N.Y. 11429

[21] Appl. No.: 67,724

[22] Filed: Aug. 20, 1979

[51] Int. Cl.[3] ..... A41C 3/00

[52] U.S. Cl. ..... 128/498; 128/509

[58] Field of Search ..... 128/498, 510, 509, 482

[56] References Cited

U.S. PATENT DOCUMENTS

| | | | |
|---|---|---|---|
| 3,173,420 | 3/1965 | Mazzoni et al. | 128/482 |
| 3,396,728 | 8/1968 | Sachs et al. | 128/498 |
| 3,561,442 | 2/1971 | Goswitz | 128/482 |

*Primary Examiner*—Doris L. Troutman

*Attorney, Agent, or Firm*—William Nitkin

[57] ABSTRACT

A brassiere designed for jogging or other sporting activity characterized by very wide shoulder straps which pass over the wearer's shoulders and cross in the back. It is also suitable for use by larger women.

2 Claims, 2 Drawing Figures

BRASSIERE

BACKGROUND OF THE INVENTION

1. Field of the Invention

This invention resides in the area of brassieres and more particularly relates to an improved design of a brassiere for utilization during jogging or other vigorous activity.

2. History of the Prior Art

Many women participate in the sport of jogging and/or other strenuous activity which have the effect of causing unwanted lateral and/or vertical movement of the breasts. Such movement is undesirable because of the discomfort it causes. Present brassiere designs do not accommodate for this movement and are unsuitable for use in jogging or other vigorous activity.

SUMMARY

It is an object of this invention to provide a comfortable and novel brassiere design particularly designed for jogging which will minimize breast movement. It is also quite suitable for other vigorous activity.

It is a further object of this invention to provide a brassiere which will support the wearer's breasts keeping them stationary, separated and slightly raised while still allowing for sufficient chest expansion for proper respiration.

DESCRIPTION OF THE PREFERRED EMBODIMENT(S)

Figure 1:
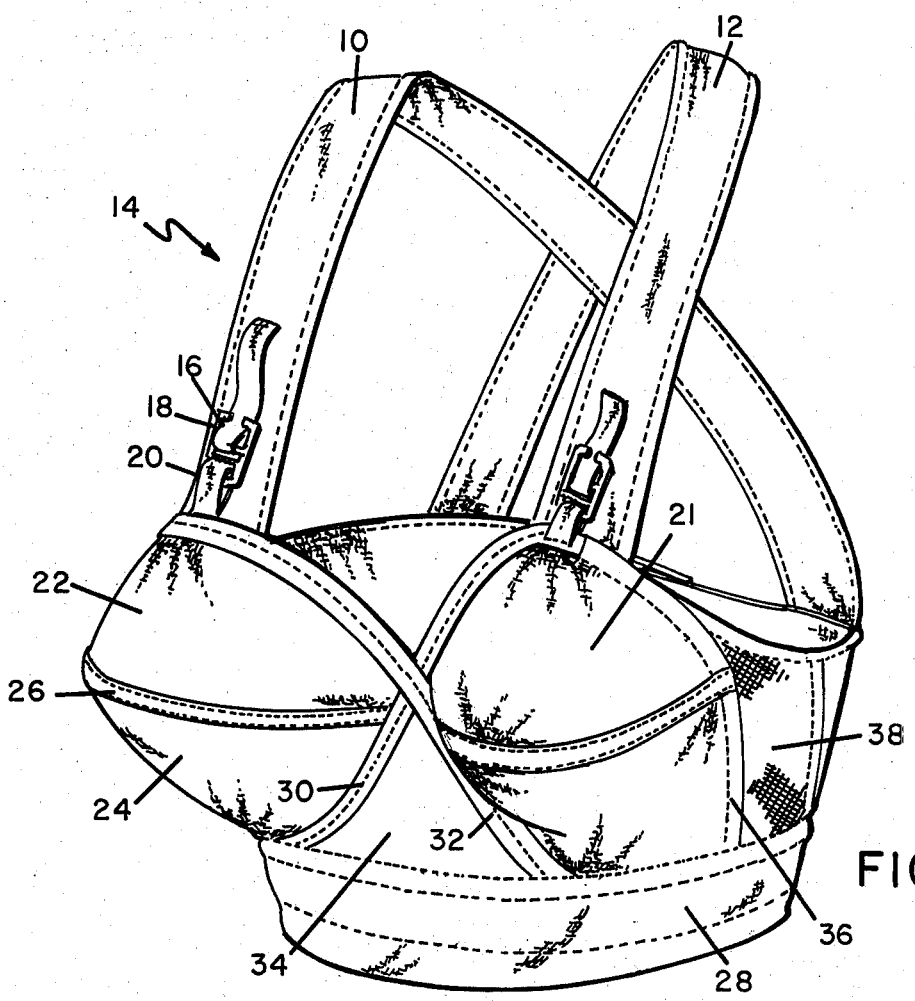
FIG. 1 illustrates a front side perspective view of the brassiere of this invention.
Figure 2:
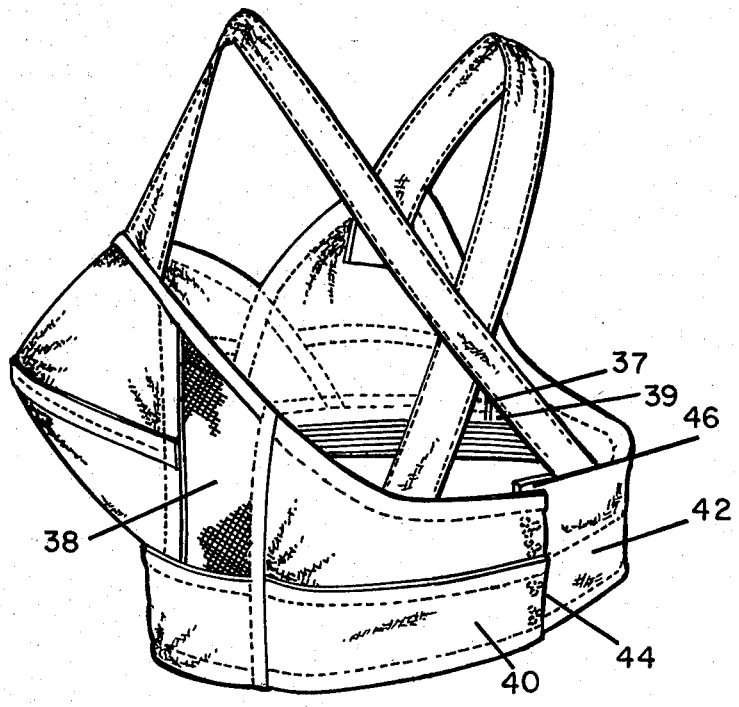
FIG. 2 illustrates a rear side perspective view of the brassiere of this invention.

The brassiere of this design seen in FIG. 1 utilizes in its structure a novel arrangement of wide first and second shoulder straps 10 and 12 which are substantially wider than normal brassiere straps. In a prototype shoulder straps of 2¼ in. in width were found to perform well. These wide shoulder straps are each affixed to first and second rear closure members 40 and 42, respectively. These straps then cross on the back of the wearer and pass over the shoulders to be adjustably and removably attached to strap attachment means 14 provided at the top of the cup members of the brassiere. Attachment means 14 can be a combination of Velcro, a tradename, and hooks 18 and loops 20 to allow for adjustments in positioning of the wide shoulder straps 10 and 12 to the cup members to the most comfortable position for the wearer. The back crossing design of the wide shoulder straps on the wearer and the extreme width of the straps secure the brassiere in a fashion that will hold the breasts stationary, separated and slightly raised and prevent movement of the brassiere independently of the wearer. The cup members of this brassiere are each formed of an upper cup member 22 and a lower cup member 24. Compression seam 26 runs horizontally therebetween passing over the nipple. Front support of the cups is in part provided by a first and second front support strap 30 and 32 which extend from the inner base of their respective cups and extend diagonally over to strap attachment means 14 forming an "X". First and second front support straps are each affixed at the base of each cup to a wide midriff band 28 which extends around and joins the first and second rear closure members 40 and 42 which have closure members 44 adapted to close in a normal fashion behind the back of the wearer. Front support straps 30 and 32 assure separation of the breasts as well as preventing medial motion. First and second side support straps 36 and 37 are positioned at the outer side of each cup. A triangular front panel is provided between the first and second front support straps and the midriff band 28. First and second elastic side panels 38 and 39 are affixed to the first and second side support straps respectively and to midriff band 28 and rear closure members 40 and 42. The side support straps 36 and 37 assist in preventing lateral and vertical movement of the breasts. The midriff band 28 can be slightly elastic and of a very wide design to prevent vertical displacement or lifting of the brassiere and breasts while at the same time allowing for sufficient chest expansion for breathing. Compression seam 26 on each cup is adapted for assisting in compression of the breasts to the shape formed by the upper cup and lower cup members. Affixed to portions of the first and second rear closure members 40 and 42 is an abrasion protection flap 46 extending under the hooks and loops so that they are well-shielded from the body and will not cause any frictional irritation to the wearer. There are no wires, stays or uncovered inner seams in the design of this brassiere. The above-described brassiere can be made of conventional undergarment materials. Absorbent materials can be utilized for absorption of perspiration for greater comfort to the wearer. Cotton simplex material has been found suitable for the production of this brassiere. It should be noted the wider straps of this improved brassiere are adapted to pass over the shoulders closer to the neck than standard brassieres so that the weight of the breasts is supported by a larger muscle mass. In standard brassieres the more narrow straps usually pass over the acromio clavicular joint but in the brassiere of this invention the wider straps are adapted to pass over the trapezius muscle.

Although the present invention has been described with reference to particular embodiments, it will be apparent to those skilled in the art that variations and modifications can be substituted therefor without departing from the principles and spirit of the invention.

We claim:

1. An exercise brassiere comprising:

first and second upper cup members;

first and second lower cup members;

first and second compression seams joining each of said first and second upper cup members respectively to said first and second lower cup members, said first and second compression seams extending horizontally at a position located over the nipples of the wearer, said first and second upper and lower cup members each having an outer side portion, an innerside portion, a top and a bottom;

attachment means positioned at the top of each of said first and second upper cup members;

first and second strap members extending respectively from the inner side of the bottom of said first and second lower cup members crossing over one another to said attachment means;

a wide midriff band extending and affixed beneath each of said first and second lower cup members;

a triangular panel positioned between said first and second strap members and said midriff band;

an outer strap member extending along the outer side of said first and second upper and lower cup members from said midriff band to said attachment means;

first and second stretchable side panels affixed to said outer strap member and said midriff band;

first and second rear closure members affixed to said midriff band and said first and second rear side panels adapted to extend around behind the wearer and include means for removably attaching one rear closure member to the other; and first and second $2\frac{1}{4}''$ wide shoulder straps, each affixed to a section of said first and second rear closure members respectively adapted to be crossed over the back and passed over the wearer's shoulders over the trapezius muscles rather than over the acromio clavicular joints as in standard brassieres with each strap having attachment means at its opposite end adapted to be affixed to said attachment means on the top of each of said upper cup members.

2. An exercise brassiere comprising:

first and second upper cup members;

first and second lower cup members;

first and second compression seams joining each of said first and second upper cup members respectively to said first and second lower cup members, said first and second compression seams extending horizontally at a position located over the nipples of the wearer, said first and second upper and lower cup members each having an outerside portion, an innerside, a top and a bottom;

attachment means positioned at the top of each of said first and second upper cup members;

first and second strap members extending respectively from the inside of the bottom of said first and second lower cup members crossing over one another to said attachment means;

a wide midriff band extending and affixed beneath each of said first and second lower cup members;

a triangular panel positioned between said first and second strap members and said midriff band;

an outer strap member extending along the outer side of said first and second upper and lower cup members from said midriff band to said attachment means;

first and second stretchable side panels affixed to said outer strap member and said midriff band;

first and second rear closure members affixed to said midriff band and said first and second rear side panels adapted to extend around behind the wearer and include means for removably attaching one rear closure member to the other;

first and second wide shoulder straps, each affixed to section of said first and second rear closure members respectively adapted to be crossed over the back and passed over the wearer's shoulders with each strap having attachment means at its opposite end adapted to be affixed to said attachment means on the top of each of said upper cup members; and wherein said attachment means are adjustable, utilizing a hook and loop fabric closure means in combination with a strap and buckle means to allow for ease and variability of adjustment of the wide shoulder straps for the comfort of the wearer.

* * * * *